United States Patent [19]

Voronin et al.

[11] Patent Number: 4,531,371

[45] Date of Patent: Jul. 30, 1985

[54] PROCESS AND APPARATUS FOR PRODUCING NITROGEN AND OXYGEN

[76] Inventors: Grigory I. Voronin, ploschad Vosstania, 1, kv. 447; Alexandr D. Suslov, ulitsa B. Spasskava, 32, kv. 312; Jury V. Chizhikov, Degtyarny pereulok, 10, kv. 6; Sergei V. Ivanov, Sevasto polsky prospekt, 44, korpus 4, kv. 260; Valentin G. Voronin, ulitsa Gorkogo 43, kv. 144, all of Moscow, U.S.S.R.

[21] Appl. No.: 660,246

[22] PCT Filed: Sep. 25, 1980

[86] PCT No.: PCT/SU80/00163

§ 371 Date: May 12, 1982

§ 102(e) Date: May 12, 1982

[87] PCT Pub. No.: WO82/01242

PCT Pub. Date: Apr. 15, 1982

Related U.S. Application Data

[63] Continuation of Ser. No. 380,932, May 12, 1982, abandoned.

[51] Int. Cl.[3] ..... F25B 9/02

[52] U.S. Cl. ..... 62/5; 62/11; 62/23; 62/27; 62/36

[58] Field of Search ..... 62/5, 11, 23, 27, 36

[56] References Cited

U.S. PATENT DOCUMENTS

| | | | |
|---|---|---|---|
| 1,952,281 | 3/1934 | Ranque | 62/5 |
| 2,548,377 | 4/1951 | Kapitza | 62/23 |
| 3,775,988 | 12/1973 | Fekete | 62/5 |

FOREIGN PATENT DOCUMENTS

| | | |
|---|---|---|
| 247967 | 5/1974 | U.S.S.R. . |
| 588137 | 5/1977 | U.S.S.R. . |
| 638815 | 12/1978 | U.S.S.R. . |
| 676829 | 7/1979 | U.S.S.R. . |

*Primary Examiner*—Ronald C. Capossela

*Attorney, Agent, or Firm*—Burgess, Ryan & Wayne

[57] ABSTRACT

A process for producing nitrogen and oxygen from a precompressed and cooled air, comprising compression of air to a pressure of from 0.3 to 0.6 MPa, cooling the compressed air to a saturated state with a partial liquefaction at a temperature of from 90° to 100° K. The cooled air with a partial content of the liquid is supplied to separation into at least one vortex tube.

An apparatus for carrying said process comprises a compressor (1) and heat-exchangers (2) positioned along the path of movement of the compressed air, which heat-exchangers have a high-pressure cavity and a low-pressure cavity, and a vortex tube (4) having, at one end thereof, an inlet nozzle (5) and a diaphragm (6) for discharging nitrogen and, at the other end thereof, a diffuser (7) for discharging oxygen. The inlet nozzle (5) of the vortex tube (4) is connected with the high-pressure cavity of the heat-exchanger (2), while the diaphragm (6) of the vortex pipe (4) is connected with the low-pressure cavity of the heat-exchanger (2).

10 Claims, 6 Drawing Figures

PROCESS AND APPARATUS FOR PRODUCING NITROGEN AND OXYGEN

This application is a continuation of application Ser. No. 380,932, filed May 12, 1982, abandoned.

FIELD OF THE ART

The present invention relates to the art of refrigeration engineering and, more specifically, to a process and apparatus for producing nitrogen and oxygen.

DESCRIPTION OF THE PRIOR ART

Known in the art and widely employed for the production of nitrogen and oxygen is a process of a low-temperature rectification comprising cooling of compressed air liquefaction thereof and separation in a rectification column (cf. U.S. Pat. No. 2,548,377 Cl. 62-123, 1951).

A great mass of the rectification column, a long running-in time in operation thereof, impossibility of changing working conditions has made it urgent to find new ways of air separation.

For example, known in the art are centrifugal rectifiers having lesser mass, though a lower reliability, since they incorporate movable assemblies (cf. A. M. Arkharov et al., "Low-Temperature Engineering", Energija Publishing House, Moscow, 1975, pp. 283–285).

Also known is a Rank vortex tube consisting of an inlet nozzle for acceleration and curling of the air stream, a diaphragm for discharge of a cooled stream and an outlet diffuser for discharging a heated stream (cf. U.S. Pat. No. 1,952,281 Cl. 62-5, 1934). In particular, vortex tubes are employed for separation of liquid hydrocarbons from gaseous ones (cf. U.S. Pat. No. 3,775,988 Cl. 62-5, 1973).

Known in the art is a process for separation of air into oxygen and nitrogen and an apparatus therefor, wherein a vortex tube is mounted before the rectification column and is used as a throttling step (cf. USSR Inventor's Certificate No. 246537, Cl. F 25 j. 1968). In this apparatus the vortex tube serves to separate vapour from the liquid and is unsuitable for air rectification.

DISCLOSURE OF THE INVENTION

It is an object of the present invention to provide a process and apparatus for producing nitrogen and oxygen which features a high operation reliability, a low mass and a short running-in time.

This object is accomplished by a process for producing nitrogen and oxygen from a preliminary compressed cooled air wherein, according to the present invention, air is compressed to a pressure of 0.3 to 0.6 MPa, the compressed air is cooled to a saturated state with a partial liquefaction at a temperature of from 90° to 100° K. and the cooled air is delivered for separation into at least one vortex pipe.

To lower power consumption in air separation in more than one tube, it is advisable to carry out air separation in at least one vortex tube under adiabatic conditions and to cool the compressed air to the saturated state with a liquid content of from 20 to 40% by mass.

To obtain more pure products, it is desirable that the separation of air in a vortex tube be conducted in a thermal contact with the ambient medium and the compressed air be cooled to the saturated state with a content of liquid of from 45 to 65% by mass.

To simultaneously produce nitrogen and oxygen upon air separation in more than one vortex tube, in at least one vortex tube the separation should be conducted under adiabatic conditions while supplying, into this vortex tube, compressed air cooled to the saturated state with a content of liquid of from 20 to 40% by mass.

The present invention also relates to an apparatus for producing nitrogen and oxygen from air which comprises a compressor and heat-exchangers positioned along the path of compressed air and having a high-pressure cavity and a low-pressure cavity and a means for air separation, wherein as the air separation means use is made of a known vortex tube having, at one end thereof, an inlet nozzle and a diaphragm for discharging nitrogen and, at the other end, a diffuser for discharging oxygen; the inlet nozzle of said vortex tube is connected with the high-pressure cavity of the heat-exchanger, while the diaphragm of said vortex tube is connected to the low-pressure cavity of the heat-exchanger.

It is advisable that the apparatus also incorporate at least one more vortex tube; the diffuser of a preceding vortex tube should be preferably connected with the inlet nozzle of the following vortex tube.

To increase the coefficient of recovery of oxygen from air, it is advisable that the diaphragm of a subsequent vortex pipe be connected with the central axial zone of the diffuser of the preceding vortex tube.

To increase stability and efficiency of operation of the vortex tube, it is advisable that along its axis be mounted a perforated hollow tube for admission of a portion of cooled air into the vortex tube.

Advantages of the present invention are based on the fact that the process for producing nitrogen and oxygen is conducted in a small-size apparatus having its own field of centrifugal forces using a small amount of liquid air.

The apparatus according to the present invention can operate under the conditions of tilts, inertional overloads which is characteristic for transport vehicles.

Small size of the separation apparatus and a small amount of liquid required for carrying out the process make it possible to rapidly run-in the apparatus to operation conditions and to switch it off when the need in products of air separation is stopped. Furthermore, due to a small-size of the apparatus, heat flows to the low-temperature part of the apparatus are small and power consumption for the production of air separation products is lower than in columns of a single-time rectification.

BRIEF DESCRIPTION OF DRAWINGS

The present invention is further explained by specific examples illustrating its embodiments and by the accompanying drawings, wherein.

BEST EMBODIMENT OF THE INVENTION

Figure 1:
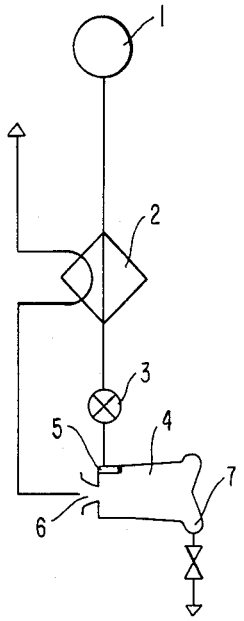
FIG. 1 shows a flow-sheet of the apparatus for producing nitrogen or oxygen for the high-pressure cycle according to the present invention.

The apparatus for producing nitrogen and oxygen according to the present invention comprises a high-pressure compressor 1 (FIG. 1) a heat-exchanger 2, throttling valve 3 and a vortex tube 4 provided at one end thereof with an inlet nozzle 5 and an outlet diaphragm 6 for discharging nitrogen and, at the other end, with a diffuser 7 for discharging oxygen. These members of the apparatus are connected therebetween by a high-pressure air supply line. The diaphragm 6 of the vortex tube is communicating with a low-pressure cavity (not shown) of the heat-exchanger 2.

Figure 2:
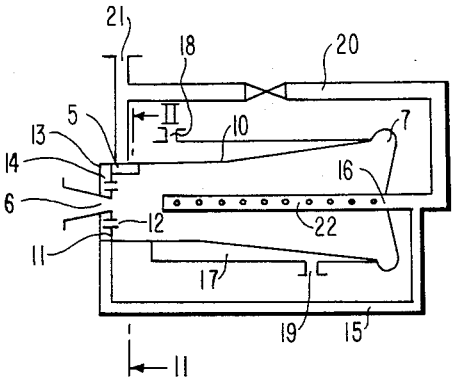
FIG. 2 is a diagram of the vortex tube.
Figure 3:
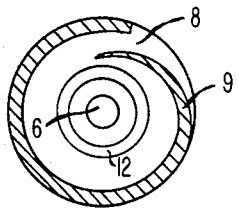
FIG. 3 is a cross-section II—II in FIG. 2.

The vortex tube 4 has an inlet nozzle 5 (FIG. 2) made as an evenly coiled conduit 8 (FIG. 3) of a diminishing cross-section in a helix 9. The inlet nozzle 5 (FIG. 2) is adjacent to an energetic separation chamber 10 made as a hollow rotation body, wherein the process of air separation occurs. The diaphragm 6 closing the chamber 10 on one side serves to discharge the stream of nitrogen, while a diffuser 7 closing the chamber 10 on the other side serves for discharging the oxygen stream. In an inner wall 11 of the diaphragm 6 there are provided openings 12 to remove the air layer effluent from the inlet nozzle 5 into the diaphragm 6 and taking no part in the process of energetic separation, to a cavity 13 formed by the wall 11 and an outer wall 14. The cavity 13 is connected, by a line 15, with an orifice 16 in the central portion of the diffuser 7. The chamber 10 is positioned inside a jacket 17, whereinto a heating agent is supplied through an inlet pipe 18 and withdrawn via an outlet pipe 19. The orifice 16 in the diffuser 7 is connected, via a line 20, with a pipe line 21, whereby compressed air is supplied into the vortex tube 4 through a hollow perforated duct 22.

More efficient, from power standpoint, is a scheme of an air-separation apparatus for the production of nitrogen and oxygen operating in a low-pressure cycle.

In this scheme, a compressor 23 (FIG. 4) is series-connected with a heat-exchanger 24, a basic heat-exchanger 25 and a condenser 26. In parallel to heat-exchanger 25 there is mounted an expander 27 mechanically connected with a compressor 28. The condenser 26 is connected by means of a high-pressure cavity (not shown) with an inlet nozzle 29 of a vortex tube 30 having its diaphragm 31 communicating with a low-pressure cavity (not shown) of the condenser 26. A diffuser 32 of the vortex pipe 30 is connected to an inlet nozzle 33 of a vortex pipe 34. A diaphragm 35 of the vortex pipe 34 is connected, a via a line 36, with the vortex pipe 30. Via a line 37 a portion of cooled air from a pipe line 38 between the heat-exchanger 25 and condenser 26 is supplied into a jacket 39 encompassing the vortex tube 34 and then withdrawn via a line 40. A diffuser 41 of the vortex tube 34 is connected with a liquid separator 42 with its vapour cavity communicating, via a line 44, with a hollow perforated duct 45 of the diffuser 41, while a liquid cavity 46 communicates, via a line 47, with a user of liquid oxygen and, via a line 48, with a low-pressure cavity (not shown) of the condenser 26.

The apparatus for producing nitrogen and oxygen according to the present invention operates in the following manner.

In a high-pressure unit air is compressed in compressor 1 (FIG. 1) to a pressure of about 20 MPa and supplied, through heat-exchanger 2 and throttling valve 3 into vortex tube 4.

The high-pressure cycle is preferred at low flow rates of the separated air and for the production of only one product of separation. In heat-exchanger 2 air is cooled by a nitrogen stream effluent from vortex tube 4, cleaned from moisture, oil vapours and carbon dioxide. Air pressure and temperature after throttling valve 3 are kept at 0.3–0.6 MPa and 90°–100° K. respectively. Into vortex tube 4, wherein the process is carried out under adiabatic conditions, air from the throttling valve 3 is fed in the saturated condition at a temperature corresponding to the condensation temperature under the expansion pressure after throttling valve 3.

Under a pressure of below 0.3 MPa the process is inefficient due to a low flow rate of the working streams in the vortex tube. Under a pressure of above 0.6 MPa the process becomes too expensive, since a further pressure increase causes a higher energy consumption rate for air compression, though it is not accompanied by a higher efficiency of separation. The amount of liquid in the cooled air may be varied within a wide range. Since the process of air separation in the vortex tube occurs at high gradients of temperature, pressure and concentration along its length and radius, there are limits of an optimal content of the liquid in the cooled air at the inlet of the vortex tube.

Air, compressed and cooled to the saturated state, is fed into the inlet nozzle 5 (FIG. 2) of vortex tube 4 which is made as a helix 9 (FIG. 3) evenly narrowing with its radius being decreased.

Figure 5:
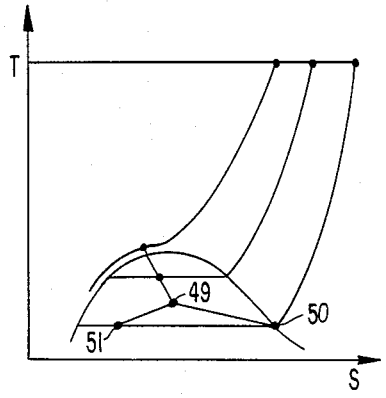
FIG. 5 is a T-S diagram for the high-pressure cycle.

The nozzle serves to supply air into the vortex tube at a given speed and for curling thereof. Since the narrow cross-section of nozzle 5 (FIG. 2) creates a considerable hydraulic resistance for the stream, pressure and temperature at the nozzle tip correspond to point 49 (FIG. 5) in the temperature-entropy diagram.

In energetic separation chamber 10 (FIG. 2) of the vortex tube 4 there occurs the process of energetic vertical separation. Two vortex streams, one peripheral moving from the inlet nozzle 5 to diffuser 7, the other axial moving from diffuser 7 to diaphragm 6 exchange their heat and mass. During the process of heat- and mass-transfer the central axial stream is enriched with nitrogen, while the peripheral—with oxygen. From the inlet nozzle 5 air passes into the energetic separation chamber 10 as a vapour-liquid mixture. The liquid, under the effect of centrifugal forces, is thrown onto the wall of the energetic separation chamber 10 and starts to flow towards diffuser 7. Nitrogen boils out of the liquid film and flows, in the peripheral stream, into the axial return vapour stream, wherefrom condensing oxygen is expelled and passed into diffuser 7 along with the liquid film. Since the vapour-liquid mixture enters into nozzle 5, the liquid can flow down into opening of the diaphragm 6, serving to discharge the nitrogen stream, along the inner wall 11 of the diaphragm 6. To prevent this phenomenon, in wall 11 of diaphragm 6 there is provided an annular opening 12 communicating with cavity 14, wherefrom the boundary layer containing a greater amount of oxygen than the nitrogen stream is discharged into the axial zone of diffuser 7 via line 15 and perforated duct 16.

The nitrogen stream from diaphragm 6 is delivered into the low-pressure cavity of heat-exchanger 2 (FIG. 1) to cool the direct air flow passing through the high-pressure cavity of this heat-exchanger. The control of the air separation process is carried out in such a manner that the pressure before the inlet nozzle 5 of vortex pipe 4 is within the range of from 0.3 to 0.6 MPa temperature—within the range of from 90° to 100° K. Higher temperature values relate to higher pressures. The low-temperature section of the apparatus is heat-insulated. In this case the weight portion of the liquid supplied into vortex pipe 4 is 20 to 40% by mass. The ratio between flow rates of the nitrogen and oxygen streams is adjusted by varying the hydraulic resistance value of the discharged streams.

Figure 4:
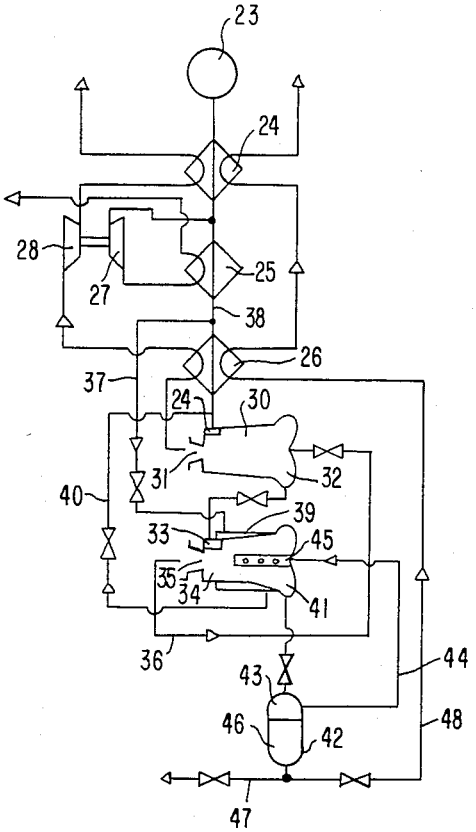
FIG. 4 is a flow-sheet of the apparatus for producing nitrogen and oxygen for the low-pressure cycle according to the present invention.

The nitrogen stream parameters are denoted by point 50 (FIG. 5), those of the oxygen streams—by point 51. It should be noted that only one of the gases, i.e. either nitrogen or oxygen, can be produced pure which is seen from the graph of the relationship of oxygen concentration in the streams vs. the nitrogen stream flow rates; in this graph curve 52 (FIG. 6) denotes the content of nitrogen at the outlet from diaphragm 31 (FIG. 4), and curve 53 (FIG. 6)—the content of oxygen in the stream effluent from diffuser 32 (FIG. 4). As the flow rate of the nitrogen stream is increased (its value is plotted along the axis X), the content of oxygen (axis Y) in this stream is reduced and reaches its minimum at a relative flow rate of the nitrogen stream defined as the ratio of the flow rate of nitrogen to the total flow rate of air equal to 0.5–0.55. Thereafter, the content of oxygen is steadily increasing with further increasing of the flow rate of the nitrogen stream and in the discharge of the entire stream through diaphragm 31 no separation of air in the vortex pipe is observed. In the oxygen flow the content of oxygen is gradually increased, reaches its maximum at a relative flow rate of the nitrogen stream equal to 0.9 and then remains constant. The maximum purity of the separation products is about 98%.

At a high demand for the air separation products, such units operating by the high-pressure cycle become inefficient from the economic standpoint.

Under these conditions oxygen and nitrogen are produced by a medium- or low-pressure cycle with an expander. Furthermore in this apparatus it is possible to obtain simultaneously two pure products, i.e. both oxygen and nitrogen.

From compressor 23 (FIG. 4) compressed air is supplied to the preliminary heat-exchanger 24 cooled by effluent streams of nitrogen and oxygen. After this preliminary heat-exchanger 24 a portion of air is supplied for expansion to an expander 27 serving to cool the main heat-exchanger 25.

The remaining portion of compressed air is cooled in the main heat-exchanger 25 and delivered to the high-pressure cavity (not shown) of condenser 26, into the low-pressure cavity whereof (not shown) nitrogen is fed from vortex tube 30.

Figure 6:
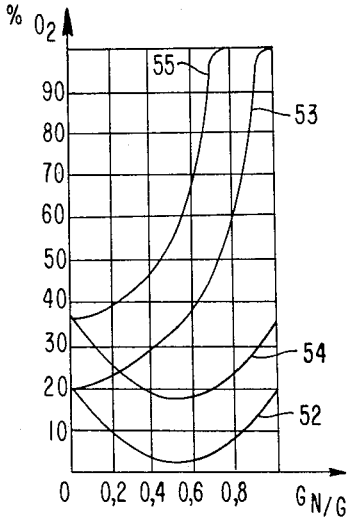
FIG. 6 is a graph showing the relationship of oxygen concentration in streams vs. nitrogen flow rate, $G_N/G$.

This vortex tube 30 is adjusted to the conditions of production of pure nitrogen according to curve 52 (FIG. 6). The nitrogen stream from vortex tube 30 (FIG. 4) passes through the low-pressure cavity (not shown) of condenser 26 and then fed, by means of compressor 28 mechanically connected with expander 27, to the preliminary heat exchanger 24, heated therein and supplied to the user. The preliminary heat-exchanger 24 serves for separation of water vapours, carbon dioxide and other contaminants from the compressed air stream and can be embodied as a switching-over heat-exchanger with one section thereof operating under cooling conditions, the other—under defrosting conditions.

From vortex tube 30 the oxygen stream is delivered into a second vortex tube 34. Since the stream passing into the vortex pipe 34 is enriched with oxygen in vortex tube 30 and contains the liquid in an amount depending on the operation conditions of vortex tube 30, the vortex tube 34 preferably operates under non-adiabatic conditions. To this end, the vortex tube 34 is provided with jacket 39.

A portion of compressed air before condenser 26 is taken-off and supplied, via line 37, to jacket 39, wherein it is condensed and recycled to the main conduit prior to vortex tube 30 via line 40.

Vortex tube 34 is adjusted for the conditions of the production of oxygen with the maximum possible concentration. Curve 55 (FIG. 6) denotes variation of oxygen concentration at the outlet of diffuser 41 (FIG. 3); curve 54 denotes the content of oxygen in the nitrogen stream at the outlet of diaphragm 35 (FIG. 4). Since the content of oxygen in the nitrogen stream in vortex tube 34 is sufficiently high, diaphragm 35 of this vortex pipe is connected by line 36 with the central axial zone of the diffuser of vortex tube 30. The content of liquid at the inlet of vortex tube 34 is 45 to 65% by mass, a portion of the liquid boils out upon heat-exchange with the air supplied into jacket 39 of vortex tube 34. Oxygen from the vortex tube 34 is delivered into the liquid separator 42. Vapour from separator 42 via line 44 is recycled to vortex pipe 34, while liquid oxygen via line 47 is supplied to the consumer. In the case of the consumer's need in gaseous oxygen, the liquid via line 48 is fed to condenser 26, wherein it is vaporized and, after heating in the preliminary heat-exchanger 24, delivered to the consumer.

To enhance efficiency of operation of the vortex pipe, along its axis a hollow perforated duct 45 is mounted, wherethrough a portion of cooled air is introduced into the vortex pipe.

EXAMPLE 1

For transportation of food products in a cooled state, it is required to fill vessels with nitrogen with a content of impurities of not more than 5% by volume at the flow rate of 20 kg/hr at a temperature of 270°–280° K.

The apparatus operates by the high-pressure cycle (FIG. 1). Air is compressed in compressor 1 to the pressure of 20 MPa, cooled in a recuperative heat-exchanger 2, throttled in throttling valve 3 to the pressure of 0.6 MPa and fed, at the temperature of 96° K., to vortex tube 4. The content of liquid in the air supplied into vortex tube 4 is 35% by mass, the air supply rate is 32 kg/hr.

EXAMPLE 2

In a chemical plant it is required to supply, every day for 8 hours, oxygen-enriched air with the content of oxygen of 70% by volume in the amount of 400 kg/hr. The apparatus is operating by the medium-pressure cycle with expander; the vortex tube operates with preheating by a portion of compressed air. The runnning-in time of the apparatus is 1 hour; the time of warming on completion of the operation is 0.5 hr so that the whole time of the apparatus operation is 9.5 hr/day. 2,500 kg/hr of air are supplied into the vortex pipe 4 for processing, wherefrom 2,000 kg/hr are passed through the expander and 500 kg/hr—through cooling jacket 17 (FIG. 2), wherein nitrogen is cooled and evaporated from the liquid film flowing along the wall of chamber 10. The amount of liquid in the air at the inlet of the vortex tube is 60% by mass.

EXAMPLE 3

In an air-separation unit operating by the low-pressure cycle it is necessary to obtain gaseous nitrogen and liquid oxygen. Air is compressed in compressor 23 (FIG. 4), cooled in heat-exchangers 24 and 25, liquified in condenser 26 to the liquid content of 25% by mass at the temperature of 96° K. under pressure of 0.6 MPa and supplied to separation into vortex tube 30. From diaphragm 31 of vortex pipe 30 nitrogen with the purity of 96 vol.% is taken-off in the amount of 60% of the supply rate of the air fed into vortex tube 30. The remaining 40% of the air enriched with oxygen to 35% by volume under pressure of 0.4 MPa are passed from diffuser 32 of vortex tube 30 to nozzle 33 of vortex tube 34. The content of liquid at the inlet of vortex tube 34 is 50% by mass. Liquid oxygen is drained into liquid separator 42, wherefrom vapours via line 44 are passed into perforated hollow duct 45 positioned along the axis of vortex tube 34. From diaphragm 35 of vortex tube 34 the oxygen-thinned stream via line 36 is fed to the central axial zone of the diffuser of vortex tube 30 at the supply rate equal to 70% of the supply rate of the air fed to vortex tube 34 at the temperature of 80° K. The amount of air supplied into jacket 39 of vortex tube 34 is equal to 10–12% of the total rate of air supply through vortex tube 30.

INDUSTRIAL APPLICABILITY

The present invention is useful in satisfying periodically arising needs in air separation products, in transport vehicles and in other applications when a neutral gas and oxygen-enriched air are required.

What we claim is:

1. A process for separating air into a nitrogen enriched stream and an oxygen enriched stream which comprises: introducing partially liquified compressed air at a pressure of from 0.3 to 0.6 MPa at a temperature in the range of 90° to 100° K. into at least one vortex tube wherein the partially liquefied air is separated into a stream enriched in oxygen and a stream enriched in nitrogen.

2. The process of claim 1 wherein said partially liquified compressed air is from 20 to 25% liquid by weight and said separation in the vortex tube is carried out under adiabatic conditions.

3. The process of claim 1 wherein the partially liquefied compressed air is from 45 to 65% by weight liquid and the separation in the vortex tube is carried out in thermal contact with a medium at a temperature higher than the temperature of the partially liquefied compressed air.

4. The process of claim 1 wherein the oxygen enriched stream from said at least one vortex tube is from 45 to 65% liquid by weight and is introduced into a second vortex tube which is contacted with compressed air whereby said compressed air is cooled and said cooled compressed air is introduced into said at least one vortex tube.

5. The process of claim 4 wherein the partially liquefied compressed air entering said at least one vortex tube is from 20 to 40% liquid by weight.

6. An apparatus for providing an oxygen enriched stream and a nitrogen enriched stream which comprises: a means for compressing air, a heat exchange means having a low pressure side and a high pressure side, each side of said heat exchange means having an inlet and an outlet, said inlet of said high pressure side being in communication with said means for compressing air, an air separating means comprising a first vortex tube having an inlet in flow communication with the outlet of the high pressure side of the heat exchange means, a diaphragm for discharging a nitrogen enriched stream in flow communication with the inlet of the low pressure side of the heat exchange means and a diffuser for diffusing an oxygen enriched stream.

7. The apparatus of claim 6 having a second vortex tube, the second vortex tube having an inlet, a diaphragm and a diffuser wherein the diffuser of the first vortex tube is in flow communication with the inlet of the second vortex tube.

8. The apparatus of claim 7 wherein the diaphragm of the second vortex tube is in flow communication with the diffuser of the first vortex tube.

9. The apparatus of claim 6 wherein a perforated hollow duct extends along the axis of the first vortex tube.

10. An apparatus of claim 8 wherein the first vortex tube has a perforated hollow duct extending along the axis thereof and said diaphragm of said second vortex tube is in flow communication with the perforated hollow duct.

* * * * *